United States Patent [19]

Beall, Jr.

[11] 4,094,505

[45] June 13, 1978

[54] TENNIS RACKET

[76] Inventor: Thomas E. Beall, Jr., 5350 Edgemoor La., Bethesda, Md. 20014

[21] Appl. No.: 756,798

[22] Filed: Jan. 4, 1977

[51] Int. Cl.[2] ..... A63B 49/02

[52] U.S. Cl. ..... 273/73 C

[58] Field of Search ..... 273/73 R, 73 C, 73 D, 273/73 E, 73 G, 73 H, 73 L, 29 A, 67 R

[56] References Cited

U.S. PATENT DOCUMENTS

| | | | |
|---|---|---|---|
| 335,656 | 2/1886 | Taylor | 273/73 R |
| 2,085,960 | 7/1937 | Donisthorpe | 273/73 R |

FOREIGN PATENT DOCUMENTS

| | | | |
|---|---|---|---|
| 827,983 | 2/1938 | France | 273/73 J |
| 431,394 | 7/1935 | United Kingdom | 273/73 C |

*Primary Examiner*—Richard J. Apley
*Attorney, Agent, or Firm*—Beall & Jeffery

[57] ABSTRACT

The shaft of the tennis racket is split between the handle and the head into two basic parts, so that a first part cantilevered from the grip supports the head, preferably with a journal, at its inner end while the second part supports the head at its outer end, preferably with a journal. The two shaft parts are unconnected so that they will flex independently of each other to maintain the head generally parallel with the axis of the grip independently of the force or positioning of the ball on the strings of the head. The shaft part that is connected between the grip and the outer end of the head is removable or displacable from the head to allow stringing of the head, and reassembly to overlie and protect the string holes along the side of the head.

9 Claims, 4 Drawing Figures

FIG. 1
PRIOR ART
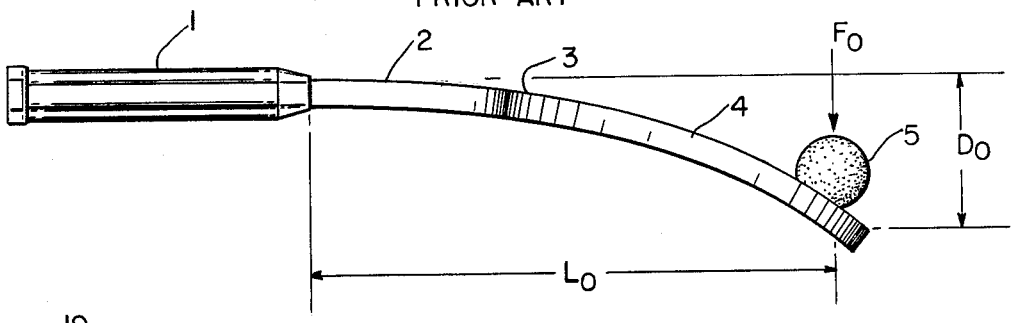
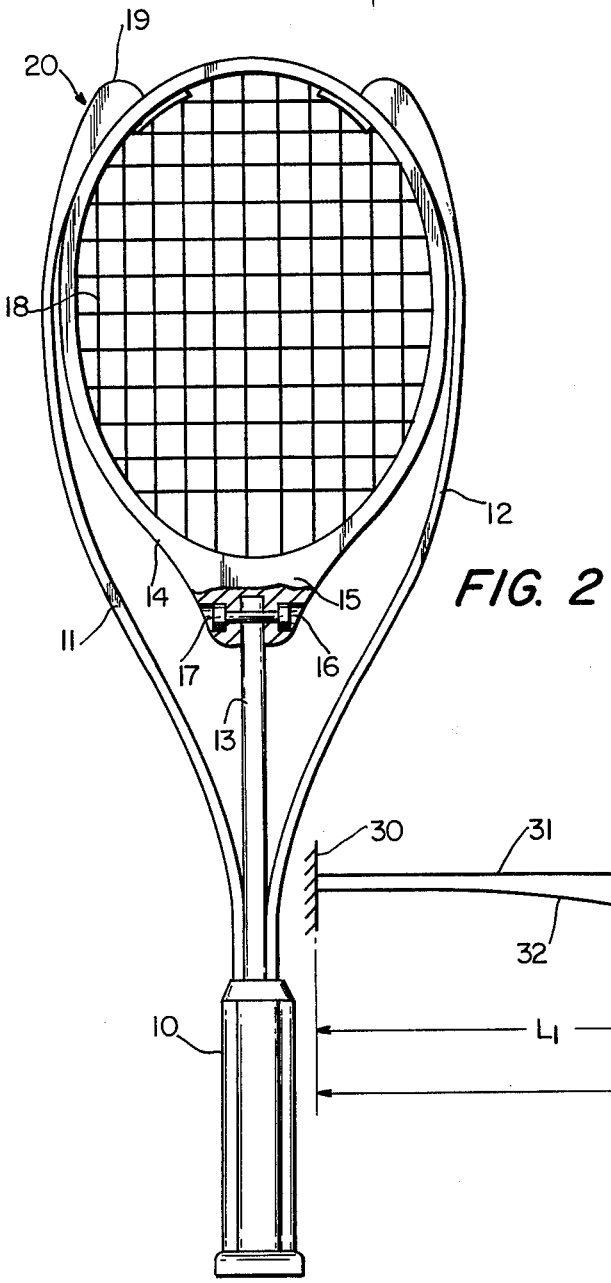
FIG. 2
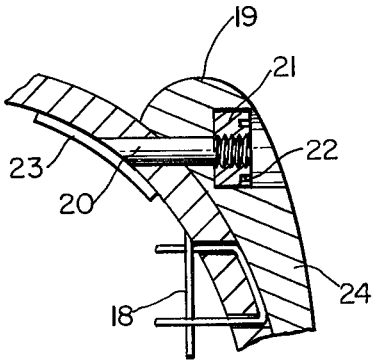
FIG. 3
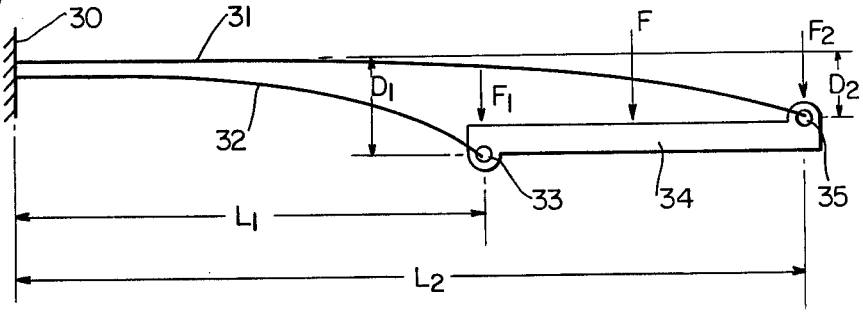
FIG. 4

TENNIS RACKET

BACKGROUND OF THE INVENTION

Conventional tennis rackets are provided with a bow strung with main strings and cross strings to form the head, which is connected at its inner end shoulder portion to the throat of a shaft, sometimes reinforced at the pallet and provided with a grip at its butt end opposite the head. Whether the shaft is provided as a single unitary member or by several members such as in the U.S. Pat. No. 2,085,960 to Donisthorpe, 1936, the same basic geometry is involved wherein the shaft assembly extends between the inner end of the head in a cantilevered manner to the grip. Such a construction has the weakness that it will bend in the manner of a cantilevered beam to change the angle of the racket head according to the force and positioning of the ball upon the strings.

There are many characteristics used to describe rackets, and one of these characteristics is the flexibility or stiffness of the racket. With increased flexibility, increased power may be obtained, but with a loss of control. High speed photography has shown that rackets of the prior art flex greatly, particularly when the ball is hit near the top of the head. In trying to hit the ball as high as possible on the serve, many players tend to hit the ball near the top of the head, and many players hit the ball in excess of 100 miles per hour. The characteristics for such a shot vary greatly from that of a baseline shot hit at low speed and in the center of the racket or towards the grip. The flexibility of the shaft will to a great extent determine which of these two shots will be hit better at the expense of the other, as an example of the role that flexibility plays in a racket.

SUMMARY OF THE INVENTION

In the present invention, it is an object to maintain, as near as possible, a parallelism between the head of the racket and the grip of the racket, over a wide range of forces upon the racket head, and a wide range of distances between the striking point on the strings and the grip.

The tennis racket is constructed with basically a two part shaft, with one part extending between the grip and the inner end of the head, and the other part extending between the grip and the outer end of the head, without any interconnection between the two shaft parts so that they may flex independently of each other. The connection between the shaft parts and the head may be formed in any manner, but preferably pivoted connections are formed, with at least the outer connections being removable to facilitate stringing of the head. The outer shaft portion overlies and protects the string holes to the side of the racket upon assembly.

BRIEF DESCRIPTION OF THE DRAWING

Further features, objects and advantages of the present invention will become more clear from the following detailed description of the drawing, wherein:

FIG. 1 is a side elevation view of a conventional tennis racket showing the manner in which the same flexes with a hard shot towards the outermost portion of the head;

FIG. 2 is a view of a preferred embodiment of the present invention;

FIG. 3 is an enlarged detail view of a portion of FIG. 2, in cross-section; and FIG. 4 is a schematic diagram, corresponding to a side view of the racket of the present invention, which shows the manner in which the racket flexes.

DETAILED DESCRIPTION OF THE DRAWINGS

A side elevation view of the conventional or prior art type of tennis racket is shown in FIG. 1 at its maximum flexure upon being hit towards the outer end of the head. This racket includes a grip 1, shaft 2, throat 3 and head 4. In the conventional manner, the shaft 2, whether of single or multi-part construction, forms a connection between the grip 1 and the inner end of the head 4. When there is a relatively large impact between ball 5 and the racket towards the outer end of the racket, that is the end of the racket farthest from the grip 1, the shaft 2, throat 3 and head 4 bend in the manner of a cantilevered beam along the length $L_0$ between the grip 1 and the ball 5. The grip 1 is generally constructed so rigid that any flexing in this area may be ignored and the grip 1 may be considered as a fixed or built in end. The bending moment at the grip end would be the force $F_0$ of the ball 5 acting upon the strings of the racket head multiplied by the distance between the impact point of the ball 5 and the point of negligible bending, which would ordinarily be the area of the pallet or the trim tape at the outer portion of the grip. Thus, the bending moment for this cantilevered beam with a built in end would be $F_0L_0$. It is seen that the bending moment would increase with increased impact force between the ball and the racket head and with increased distance between such impact and the grip.

For a built in cantilevered beam of constant cross-section throughout its length and of a material having the same strength characteristics throughout its length, the maximum deflection $D_0$ at the point where the force $F_0$ is applied would be obtained from the following equation:

$$\text{Maximum deflection} = (F_0L_0^3/3(EI))$$

where E would be Young's Modulus of Elasticity and I would be the moment of inertia of the cross-sectional area. It is seen from this equation that the deflection would increase in direct proportion with the force of striking the ball, but the deflection would increase in porportion to the distance between the grip and the ball to the 3rd power, that is, the position at which the ball strikes the racket has a tremendous effect upon the deflection of the racket. As an example, if one shot hit the racket with a force twice as great as a second shot, with both shots hitting the strings at exactly the same point, the first shot would produce twice the deflection of the second shot. If two shots were hit equally hard, with one being on the strings closely adjacent the throat and the other being on the strings at the outermost portion of the head, it may be seen from the geometry of the average racket that the second shot strikes the racket at a distance $L_0$ approximately twice the distance $L_0$ of the first shot, and accordingly, the difference in deflection would be $2^3$ or 8, that is, the deflection of the second shot would be approximately 8 times as great as the deflection of the first shot. Beams of varying cross-section and variable strength characteristics along their extent present more complicated problems, with respect to determining their deflection, but generally the above analysis would hold true.

A preferred embodiment of the present invention is shown in FIGS. 2 and 3 by way of an example of a construction employing the principles of the present invention.

The handle or grip 10 may be of conventional construction and its exact construction is not important so long as it provides a rigid mounting and a comfortable gripping portion for the players hand. What may generally be referred to as the shaft of the racket comprises three parts 11, 12, 13. Outer portions 11, 12 are preferrably mirror images of each other and in fact may be of identical construction and only reversed with respect to their orientation. Shaft parts 11, 12 and 13 are preferrably rigidly mounted within the interior of the grip 10 in a permanent manner, but otherwise not connected with each other. That is, where the shaft portions 11 and 12 extend closely adjacent the shaft portion 13, it is preferrable that there be no rigid interconnection so that each may be free to bend within a plane perpendicular to the plane of FIG. 2 along their length independently of the others. However, it is also contemplated that the shaft portions 11, 12 and 13 may be secured together where there are shown adjacent each other, particularly with an extended grip for players who employ a 2-handed shot.

The bow 14 of the racket is provided with an integral throat portion 15 having a cross bore 16 with opposite outer enlarged portions. The outermost end of the shaft portion 13 is provided with a corresponding end aligned bore for the reception of a cross pivot pin 17 extending through the bore 16 of the throat 15 and the aligned bore of the shaft portion 13. This pivot pin 17 may permanently or releasably secure the throat 15 to the shaft portion 13, but in any event provides a pivoted connection between the throat 15 and the shaft 13 for relative limited pivotal movement about the axis of the pin 17 that is perpendicular to the longitudinal axis of the shaft portion 13. The principles of the present invention may also be accomplished with a rigid connection between the shaft portion 13 and the throat 15.

The bow 14 may be of any construction, for example of a conventional laminated wood construction, or laminated synthetic material construction, or metallic construction. Any type of main and cross strings 18 are strung within the bow 14 only, that is, such strings 18 do not extend into the shaft portions 11 and 12, and for the purpose of stringing the racket, the shaft portions 11 and 12 will be removed from the bow 14.

The shaft portions 11 and 12 extend in a cantilevered manner from the grip 10 along the sides of the bow 14 to the outer end of the bow 14 or racket head. The only securement between the bow 14 and the shaft portions 11 and 12 is by means of releasable fasteners 20, which preferably also form pivotal connections between the shaft portions 11, 12 and the bow 14. For this purpose, the outermost ends of the shaft portions 11, 12 are enlarged at 19 and provided with cross bores generally parallel with the cross bore 16 that aligned with corresponding cross bores in the bow 14 for the reception of the fasteners 20. As more clearly shown in FIG. 3 as a specific example, the cross bore of the enlarged portion 19 may be enlarged at its outermost end at 24 for the reception of a nut 21 threaded upon the fastener 20, which fastener 20 has an enlarged head that extends along the inner surface of the bow 14. For this purpose, the head 23 may be angled with respect to the shaft of the fastener 20 to correspond to the angle between the inner surface and cross bore of the bow 14. The nut 21 is provided with opposed recesses 22 for the reception of a suitable tool to assist in rotating the nut, which therefore may have a rounded exterior complementary to the bore 24. Any type of releasable fastener may be employed, and the fastener as such forms no part of the basic invention.

It is also contemplated that the shaft portions 11 and 12 may be unitary with each other at their outer ends, that is they may combine to form a general U-shape at their outer end and provided with a single connection between the bite of the U and the outermost end of the bow 14, which connection would be releasable. With such a construction, it would probably be necessary to provide a telescopic releasable connection between the inner ends of the shaft portions 11, 12 and the handle 10, to facilitate removing the shaft portions 11 and 12 sufficiently far from the bow 14 to permit stringing. However, if a permanent connection was provided between the grip 10 and the innermost ends of the shaft portions 11 and 12 of the U-shaped construction, it is possible that after releasing the fastener between such a U-shaped shaft portion and the bow 14, the bow 14 and the U-shaped shaft portions could be bent in opposite directions in a plane perpendicular to the plane of FIG. 2 to separate them sufficiently for the purpose of stringing the bow.

With a conventional construction of the bow 14 with respect to holes and slots for the reception of the strings 18, it is seen that the shaft portions 11, 12 provide a function of protecting such strings by overlying the string holes along the sides of the bow. Since the shaft portions 11, 12 are not in any way connected with the strings, their shape may be completely independent of the string mounting, and desirably rounded in the vicinity of the sides of the bow 14 to prevent the racket from digging into a clay court surface when a low shot is hit.

If desired, the fasteners 20 may be supplied in different weights to change the balance of the racket quite easily and reduce the inventory that would be required.

However, the most desirable characteristics of the present invention are set forth schematically in FIG. 4 wherein the grip 10 is represented as a fixed mounting 30 rigidly securing the cantilevered beams 31, 32 that correspond respectively to the shaft portion 11, 12 and the shaft portion 13. The bow 14 is represented as a rigid element 34, although in fact it may be desirable to provide considerable flexibility in the bow 14. The pivotal connection 20 of FIG. 2 is represented at 35 in FIG. 4 and the pivotal connection 17 of FIG. 2 is represented at 33 in FIG. 4. Without any force being applied to the member 34, the elements 31, 32, 33, 34, and 35 will generally lie in the same plane. However, the mechanism is shown in FIG. 4 with forces being applied to it to deflect the cantilevered beams 31, 32.

Whatever force is applied to the member 34 may be broken into a force F1 applied to the pivot 33 and a force F2 applied to the pivot 35. Thus, the force of the ball striking the racket $F_0$ would equal the sum of F1 and F2. The beam 31 would function as a cantilevered beam independently of the beam 32 and would have a maximum deflection $D_2$ that would be equal to $F_2L_2^3 \div 3EI$, with the assumption that the beam strength and cross-sectional area do not change along its length. Similarly, the maximum deflection $D_1$ for the beam 32 would correspondingly equal $F_1L_1^3 \div 3EI$, with corresponding assumptions. Since the force F2 will have a negligible effect, if any, upon the deflection of the beam 32 and since the distance $L_2$ does not change much for the beam 31 irrespective of where the ball strikes the member 34, it is seen that these beams 31, 32 act substantially independently of each other so that for equal forces $F_1$ and $F_2$, the beams 31 and 32 could easily be constructed so as to have identical deflections $D_1$ and $D_2$; under these conditions with equal forces $F_1$ and $F_2$ resulting in equal deflections $D_1$ and $D_2$, the member 34 would remain parallel throughout the full range of forces applied from zero to the maximum force applied to the member 34, which would mean that the bow 14 or head of the racket would remain parallel to the grip 10 irrespective of the magnitude of the force applied, so long as the force applied to the bow 14 would result in equal forces applied to the connections 17, 20. Thus, if the ball hit the strings 18 at a position midway between the fasteners 20 and the fastener 17, the racket head or bow 14 would remain parallel to the grip 10 irrespective of the force of such a shot.

The relationship between F1 and F2 will vary according to the variation of the point of impact between the ball and the strings, so that as the impact point moves towards the outer end of the bow 14, the force F2 will increase relative to F1, and correspondingly, the deflection $D_2$ will increase relative to the deflection $D_1$, so that the parallel relationship between bow and the grip will change. If a summation of the moments about the point of impact is taken, it will be seen that $F_2L_2$ equals $F_1l_1$, with $L_2$ being the distance between the point of impact and $F_2$, and $l_1$ being the distance between the point of impact and $F_1$. With a rearrangement of the terms, it is seen that $F_1$ equals $F_2(L_2 \div L_1)$, which indicates that the forces are related to each other according to the ratio of their distances from the point of impact. Since the deflection of the beams 31, 32 will only be related to the magnitude of the forces $F_1$ and $F_2$, since the lengths $L_1$ and $L_2$ remain constant as do the strengths and cross-sections of the beam with respect to different impacts, it is thus seen that the deflection $D_1$ would equal the deflection $D_2(L_1 \div L_2)$.

In view of the above relationship, it would be preferable to have the pivot points 17 and 20 spaced outwardly from the range of positions where the ball may strike the strings 18, and with respect to FIG. 2, it is seen that the pivot point 17 is spaced a considerable distance from the closest point at which the ball may fully strike the strings 18. It would therefore be desirable to move the illustrated fasteners 20 to the outermost portion of the bow 14 and in fact spaced even a considerable distance therefrom with the provision of a connection similar to that shown at 15–17. With such an arrangement, the minimum values for L1 and L2 would not be so small in relationship to their maximum values and accordingly the range of possible values for the relationship between L1 and L2 would be narrow.

By way of a specific example, let it be assumed: that the connection 35 extends outwardly one inch from the outermost portion of the bow 14; that the ball 5, due to its rounded configuration, can strike the strings at its outer extreme position only inwardly one inch from the outermost portion of the bow 14 (which would be a modification of what is shown in FIG. 2); that the connection 33 extends inwardly one inch from the innermost portion of the bow 14; that the ball 5, due to its rounded configuration, can strike the strings at its inner extreme position only outwardly 1 inch from the innermost portion of the bow; and that the length of the bow as measured from its outermost portion to its innermost portion is 10 inches. Thus, maximum ratio of the lengths L1 and L2 would be the ratio of the numbers 2 and 10, or 5, which would be 5. If the deflection $D_1$ were one inch, then the deflection $D_2$ would be 5 inches, so that the tangent of the angle between the plane of the bow 14 and the axis of the grip 10 would have a maximum value of 5 minus 1 over 10 + 1 + 1, or $\frac{1}{3}$, which would correspond to an angle of approximately 18°.

With respect to a racket having a fixed connection between the shaft portion 13 and the throat 15: (1) the bow 14, shaft portion 13 and grip 10 would function as a conventional tennis racket and have an angular deflection as shown in FIG. 1 if the shaft portions at 11 and 12 were not connected; (2) if under the same force conditions as (1) the shaft portions 11 and 12 were connected, it is seen that the angular deflection would be less due to the support for the outer portion of the bow 14, and correspondingly the control and consistency of the racket would be greater as compared to a conventional tennis racket (1); (3) if then the shaft portion 13 of (2) were made more flexible under the same force conditions, then shaft portion 13 would bend more than in (2) and the angular deflection of the head 14 would be even less than under (2).

Since the disadvantages associated with flexibility as to deflection will be greatly overcome with the present invention, the throat portions 11, 12, 13 may be made highly flexible. Also, a conventional tennis racket exhibits entirely different flexibility characteristics with respect to the distance between the point of impact and the grip, which variation characteristics would be largely eliminated from the present invention.

While a preferred embodiment of the present invention, with variations and modifications has been set forth in detail for purposes of illustration and the importance of the details, further embodiments, modifications and variations are contemplated according to the broader aspects of the present invention, all as determined by the spirit and scope of the following claims.

What is claimed:

1. A racket, having orientations of an inner end toward the player and an outer end away from the player comprising: a rigid handle having a gripping surface to be held by the player; a bow having opposed sides and opposed inner and outer ends; main strings strung from end to end of said bow and cross-strings strung side to side on said bow; first shaft means extending cantilevered from said handle to a direct mechanical connection with only the inner end of said bow; second shaft means cantilevered from said handle outwardly to a mechanical direct connection with only the outer end of said bow; said first and second shaft means extending from said handle independently of each other to flex as cantilevered beams separately according to forces exerted only at their outer ends through their respective mechanical connection to the inner and outer ends of said bow; and each of said first and second shaft means being unconnected to and freely movable with respect to said opposed bow sides.

2. The racket of claim 1, including fastener means at the outer end of said bow and forming the mechanical connection between said bow and said second shaft means, and said fastener means being releasable to permit movement of said second shaft means away from said bow for the stringing of said bow without interference from said second shaft means.

3. The racket of claim 2, wherein said second shaft means is constructed of a first shaft portion extending from said handle along one side of said first shaft means, along the corresponding side of said bow and to its connection at the outer end of said bow, and a second shaft portion extending from said handle along the other side of said first shaft means, along the other side of said bow and to its connection with the outer end of said bow; and said shaft portions being mirror images of each other.

4. The racket of claim 3, wherein each of said shaft portions extend from said handle in a direction generally parallel to each other and said first shaft means, thereafter bows away from said first shaft means and then reversely bows inwardly towards the sides of said bow to provide a reverse bend between said handle and said bow that will flex to accommodate a small variation in distance between said handle and the connection between said bow and said second shaft means as both of said shaft means bend upon impact with a ball striking the strings of said bow; and each of said first shaft means, first shaft portion and second shaft portion having a rigid connection with said handle.

5. The racket of claim 4, wherein said first shaft means is rigidly connected to said bow.

6. The racket of claim 5, wherein said second shaft means is rigidly connected with said bow.

7. The racket according to claim 1, wherein the connection between said first shaft means and said bow is a rigid connection.

8. The racket according to claim 7, wherein the connection between said second shaft means and said bow is a rigid connection.

9. The racket according to claim 1, wherein the connection between said first shaft means and said bow is a pivotal connection with a pivot axis extending generally perpendicular to the longitudinal axis of said handle.

* * * * *